United States Patent [19]

Leonard

[11] 4,162,957

[45] Jul. 31, 1979

[54] METHOD OF FEEDING SOLIDS TO A PROCESS UNIT

[75] Inventor: Robert E. Leonard, Oklahoma City, Okla.

[73] Assignee: Kerr-McGee Corporation, Oklahoma City, Okla.

[21] Appl. No.: 888,283

[22] Filed: Mar. 20, 1978

[51] Int. Cl.[2] ..... C10G 1/00

[52] U.S. Cl. ..... 208/8 R; 208/8 LE

[58] Field of Search ..... 208/8 LE, 8 R

[56] References Cited

U.S. PATENT DOCUMENTS

| | | | |
|---|---|---|---|
| 2,846,361 | 8/1958 | Mekler | 208/8 LE |
| 3,607,716 | 9/1971 | Roach | 208/8 LE |
| 3,607,718 | 9/1971 | Leaders | 208/8 |
| 3,985,637 | 10/1976 | Storrs | 208/8 R |
| 4,058,205 | 3/1977 | Reed, Jr. | 208/8 R X |
| 4,077,868 | 3/1978 | Chambers | 208/8 R X |

*Primary Examiner*—Delbert E. Gantz
*Assistant Examiner*—William G. Wright
*Attorney, Agent, or Firm*—William G. Addison

[57] ABSTRACT

The present invention relates to a process wherein solidified coal liquefaction products with or without other solid materials can be simultaneously melted and introduced at an elevated pressure into a process unit. The melting and introduction of the coal liquefaction products with or without other solid materials into the process unit is accomplished by an extruder.

18 Claims, 1 Drawing Figure

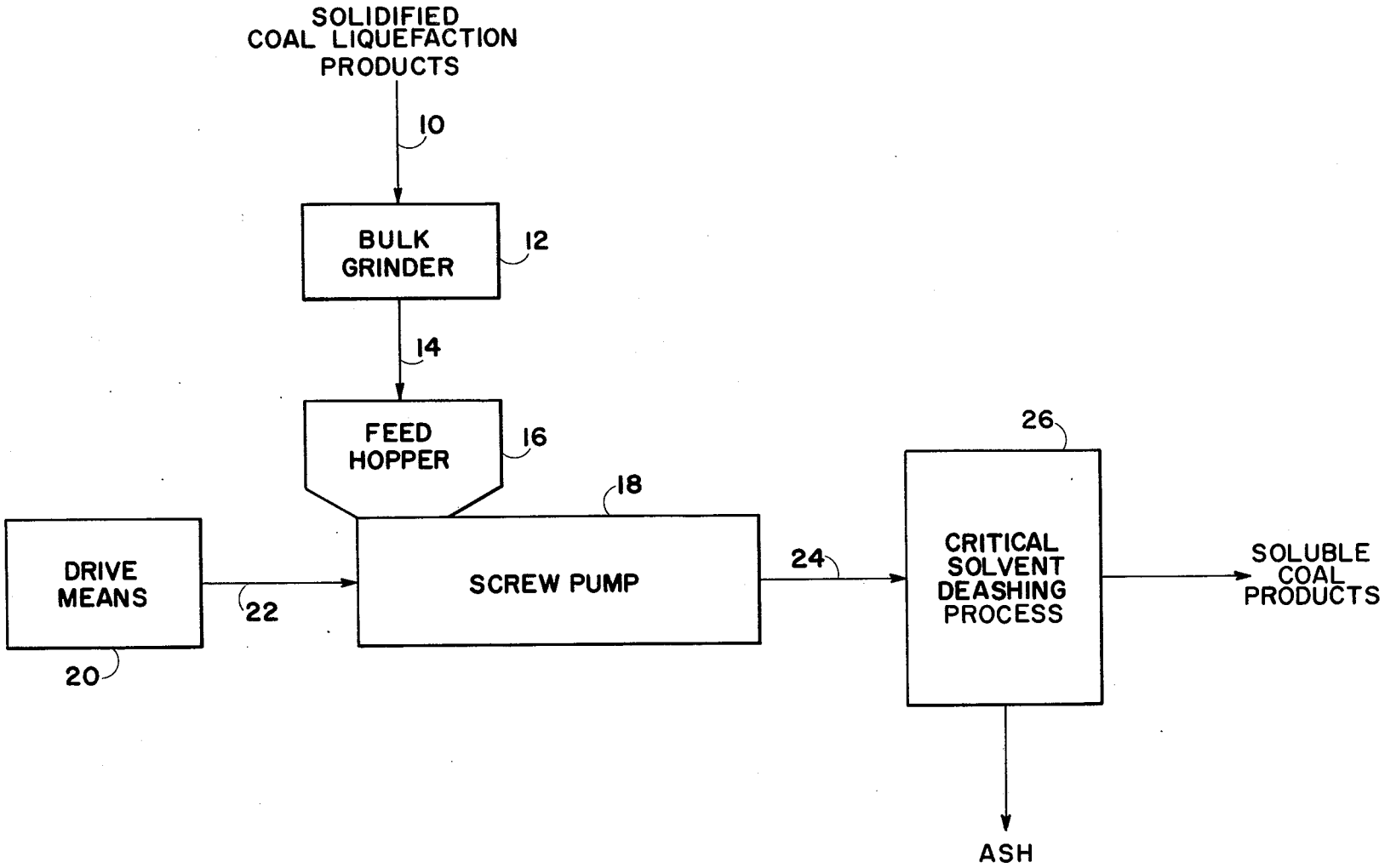
SOLIDIFIED COAL LIQUEFACTION PRODUCTS
10
BULK GRINDER
12
14
FEED HOPPER
16
SCREW PUMP
18
22
DRIVE MEANS
20
24
CRITICAL SOLVENT DEASHING PROCESS
26
SOLUBLE COAL PRODUCTS
ASH

METHOD OF FEEDING SOLIDS TO A PROCESS UNIT

BACKGROUND OF THE INVENTION

1. Field of the Invention

This invention relates to a method of conveying meltable particulate solids and more particularly, but not be way of limitation, to conveying meltable hydrocarbonaceous solids into processing equipment operated at elevated pressures.

2. Description of the Prior Art

In a process to convert coal into a low ash, low sulfur fuel it is necessary to remove a portion of the inorganic sulfurous material by a solids removal procedure. An economical method for accomplishing this solids removal procedure is through the use of a critical solvent deashing process such as that disclosed in U.S. Pat. Nos. 3,607,716, 3,607,717 and 3,607,718 assigned to the same assignee as the present invention. In that process, an ash and sulfur containing product from a coal liquefaction process is contacted with a select solvent maintained at an elevated temperature near the critical temperature of the solvent and at an elevated pressure. A portion of the mineral ash and other sulfurous material as well as a portion of the undissolved and soluble coal is caused to separate by gravity from the major portion of the soluble coal and solvent. The remaining substantially ash-free soluble coal then is separated from the solvent by increasing the process temperature in a subsequent separation step.

Heretofore, it has been contemplated that the coal liquefaction product introduced as feed material to the critical solvent deashing process would constitute a molten residuum obtained directly from a vacuum still or other fractionation vessel. The use of such a molten material feed creates several problems in the event the critical solvent deashing process is inoperative for mechanical reasons or its operation is not otherwise presently required. The major problem is that the coal liquefaction product is thermally unstable. At the temperature required to maintain the coal liquefaction product in a molten condition, the soluble coal will polymerize and form materials insoluble under the operating conditions of the critical solvent deashing process. Such polymerization results in the loss of this otherwise soluble material as it will be separated and removed with the ash and sulfurous material rather than the soluble coal products during the deashing process. A further problem arises in providing a practical means of storing the large quantities of molten material before deashing.

It would be highly advantageous to be able to operate the critical solvent deashing process with a solid feedstock. Thus, a solid feedstock can be stored and transported more easily than a molten material. Further, it is not as subject to thermal degradation when in the cold, solid form. The coal liquefaction product can be melted readily and introduced into the critical solvent deashing process as additional feed is required. The melting of the coal liquefaction product, however presents another problem. The conventional method of liquefying meltable solids is to batch melt the solids in large tanks. That technique has the disadvantage that to provide a continuous flow of molten material, the tanks must be large in volume. The tanks also must possess a large surface area for heat transer to melt the material due to the low heat transfer properties of viscous liquids such as coal liquefaction products.

The batch melt technique requires a large capital investment in the melting tanks and the pumps required to transport the molten feed into the deashing process apparatus. Further, because of the long retention times at elevated temperatures to effect complete melting of the tank contents, thermal degradation through polymerization can occur when the molten material is held in the large tanks.

SUMMARY OF THE INVENTION

The discovery now has been made that a heated extruder can efficiently and rapidly melt solidified coal liquefaction products and other meltable particulate solids for introduction into the apparatus of a process unit. The heated extruder can simultaneously melt the material and introduce the melted material into the process apparatus at an elevated pressure. The use of a heated extruder eliminates the need for large melt tanks and additional pumping equipment. Further, the problem of polymerization is alleviated due to the very short time the solidified coal liquefaction products and other meltable particulate solids are maintained in a molten condition before introduction into the process unit, such as for example, critical solvent deashing process apparatus. The heating can be accomplished by electrical resistance, circulation of heat transfer fluids or direct fired techniques.

DESCRIPTION OF THE DRAWING

The single FIGURE diagrammatically illustrates apparatus arranged in accordance with the process of the present invention.

DESCRIPTION OF THE PREFERRED EMBODIMENT

Turning now to the single FIGURE, a coal derived feed such as coal liquefaction products in solid form is introduced into a bulk grinder 12 by a transport means 10. For illustration purposes, the coal derived feed described hereafter is solidified coal liquefaction products or fractions thereof containing soluble coal products, mineral ash, undissolved coal and other sulfurous material remaining after solubilization of raw coal. The transport means 10 may comprise any of the numerous means known to those skilled in the art, for example, a conveyor belt.

The bulk grinder 12 reduces the size of the solidified coal liquefaction products to a relatively uniform particulate size, for example, in the range of less than one half inch in diameter. The particular size to which the feed is ground depends upon the size of the subsequent melting apparatus to be more fully described hereinafter. The ground particulate feed flows from the bulk grinder 12 through a conduit 14 to a particulate feed hopper 16.

The feed hopper 16 is positionally disposed in intimate physical relationship with a heated extruder 18. The extruder 18 comprises a hollow cylinder with an inner cylinder that has a helical flight thereon and that is capable of rotation within the hollow cylinder. The inner cylinder or screw can be tapered or possess a flight of variable pitch. The extruder 18 also can comprise twin screws which intermesh within the hollow cylinder. The motive power for the screw is provided by a drive means 20 connected to the extruder 18 by a coupling means 22.

The particulate feed is introduced into one end of the extruder 18 by rotation of the screw. The feed is transported through the extruder 18 by the action of the helical flight contained therein. Heat is applied to the extruder 18 by any method known to those skilled in the art, such as by electrical resistance heating, circulation of a heated fluid within a passageway provided within the extruder 18 or direct fired techniques employing the heated gases of a combustion reaction. The application of heat and the extreme mechanical forces generated within the extruder 18 cause the feed to melt. The mechanical forces also cause the feed to be compressed due to the design of the extruder.

In some applications, the mechanical forces applied to the feed within the extruder 18 can generate sufficient heat energy through friction to melt the feed without the necessity of external heating.

The molten feed is discharged from the heated extruder 18 into a conduit 24. The compression within the extruder 18 elevates the pressure on the molten feed to such an extent that the molten feed can be introduced directly into a process unit 26 such as a critical solvent deashing process unit via the conduit 24. The process unit can comprise generally either a hydrogenation unit or a thermal processing unit.

The heated extruder 18 provides a method by which solidified coal liquefaction products can be simply, efficiently and rapidly melted. The short retention time within the extruder substantially alleviates any problems associated with polymerization of the feed material. The molten feed can be introduced directly into a process unit, such as for example, critical solvent deashing process apparatus. This also eliminates the necessity of additional pumping apparatus associated with conventional melt tanks.

In an alternate embodiment the extruder 18 can simultaneously mix solidified coal liquefaction products with finely divided raw coal to provide upon melting a slurry thereof. The slurry then is discharged from the extruder 18 at an elevated temperature and pressure for introduction into a process unit. In certain circumstances it may be necessary to pump the discharged slurry of molten feed into the process unit with an additional pump such as, for example, a plunger type pump, a piston type pump, a screw type pump or a gear type pump and the like. However, the additional energy required to be imparted to the molten feed by the pump to effect the feed's movement is less than the energy required to effect movement of the feed were it to be contained in large melt tanks.

For the purpose of illustrating the present invention, and not by way of limitation, the following Example is set forth.

EXAMPLE

A solidified coal liquefaction product feed is provided. The feed is analysed and found to have the analyses set forth in Table I below.

TABLE I

| | |
|---|---|
| Specific Gravity 60/60 | 1.34 |
| Proximate Analysis | |
| % Loss at 105° C. | 0.4 |
| % Volatile Matter | 44.7 |
| % Fixed Carbon | 41.5 |
| % Ash | 13.4 |

The feed is ground to a particle size of $-\frac{1}{4}''+16$ mesh and introduced into a feed hopper, such as shown in the accompanying drawing, located above the inlet to the screw extruder which is operated to simultaneously melt the feed and introduce said molten feed continuously into an elevated pressure process unit at a rate of 12.75 lbs/hr. The elevated pressure is 700 psig.

It is determined that to provide such a continuous flow of molten material with a melting tank and pumping system requires 0.077 $ft^3$/lb/hr for melting and 0.95 $ft^3$/lb/hr for pumping the molten feed for a total of 1.027 $ft^3$/lb/hr. By way of contrast, it is determined that the extruder requires only 0.3 $ft^3$/lb/hr to simultaneously melt and pump an equal quantity of the feed into the process unit.

While the present invention has been described with respect to what at present is considered to be the preferred embodiment thereof, it is to be understood that changes or modifications can be made in the process and apparatus without departing from the spirit or scope of the invention as defined in the following claims.

What is claimed is:

1. A process for simultaneously melting and introducing a solid, coal derived feed into a process unit comprising:
   - introducing said solid, coal derived feed into an extruder;
   - heating said solid, coal derived feed within said extruder to melt said feed and provide a molten feed;
   - discharging said molten feed from said extruder at an elevated pressure; and
   - introducing said discharged molten feed into a process unit.

2. The process of claim 1 wherein the extruder has a tapered screw.

3. The process of claim 1 wherein the extruder has a variable pitch screw.

4. The process of claim 1 wherein the heating is facilitated by electrical resistance heating.

5. The process of claim 1 wherein the process unit is a critical solvent coal deashing process unit.

6. A process for feeding solid carbonaceous material to a process unit comprising:
   - providing solidified coal liquefaction products;
   - providing finely divided raw coal;
   - simultaneously introducing said solidified coal liquefaction products and said finely divided raw coal into an extruder;
   - mixing said solidified coal liquefaction products and said finely divided raw coal within said extruder to form a mixture;
   - melting said mixture within said extruder to form a slurry; and
   - discharging said slurry from said extruder at an elevated temperature and pressure into a process unit.

7. The process of claim 6 wherein the process unit is a hydrogenation unit.

8. The process of claim 1 wherein the heating is facilitated by contacting the extruder with hot combustion products.

9. The process of claim 1 wherein the heating is facilitated by circulation of a heated fluid within a passageway provided within the extruder.

10. The process of claim 1 wherein the heating is facilitated by direct firing of the extruder.

11. The process of claim 6 wherein the process unit is a thermal processing unit.

12. A process for feeding a particulate solid consisting of coal liquefaction products into a process unit comprising;

introducing said particulate solid into an extruder;

melting said particulate solid within said extruder to provide a molten feed;

discharging said molten feed from said extruder; and pumping said molten feed into a process unit.

13. The process of claim 12 wherein pumping is facilitated by a plunger type pump.

14. The process of claim 12 wherein the process unit is a hydrogenation unit.

15. The process of claim 12 wherein the process unit is a thermal processing unit.

16. The process of claim 12 wherein pumping is facilitated by a piston type pump.

17. The process of claim 12 wherein pumping is facilitated by a screw type pump.

18. The process of claim 12 wherein pumping is facilitated by a gear type pump.

* * * * *